US005200135A

United States Patent [19]

Vargas-Gutierrez et al.

[11] Patent Number: 5,200,135

[45] Date of Patent: Apr. 6, 1993

[54] METHOD TO IMPROVE THE SERVICE LIFE OF GAS INJECTION DEVICES USED TO INTRODUCE A GAS INTO MOLTEN METAL

[76] Inventors: Gregorio Vargas-Gutierrez; Carlos Maroto-Cabrera, both of Ave. Junco de la Vega #208, Col. Roma 64700 Monterrey, Nuevo Leon, Mexico

[21] Appl. No.: 926,379

[22] Filed: Aug. 10, 1992

Related U.S. Application Data

[63] Continuation of Ser. No. 733,220, Jul. 22, 1991, abandoned.

[51] Int. Cl.[5] ..... C21B 7/16

[52] U.S. Cl. ..... 266/47; 266/220

[58] Field of Search ..... 266/47, 217, 220, 270, 266/265, 268

[56] References Cited

U.S. PATENT DOCUMENTS 3,330,645 7/1967 Moustier et al. ..... 266/220
4,695,043 9/1987 Winkelmann et al. ..... 266/265

FOREIGN PATENT DOCUMENTS 3901926 12/1989 Fed. Rep. of Germany ..... 266/265
0229408 12/1984 Japan ..... 266/217

*Primary Examiner*—Scott Kastler
*Attorney, Agent, or Firm*—Laurence R. Brown

[57] ABSTRACT

A method to improve the service life of gas injection devices is disclosed.

A porous mushroom with controlled permeability is formed, previously to the element installation, in the tip of said element by a thermal spray process.

By controlling gas flow rate and pressure during the mushroom formation, the gas permeability in said mushroom is controlled.

The sprayed materials are high melting point ceramics, metal compounds or synthetic slags.

3 Claims, 2 Drawing Sheets

METHOD TO IMPROVE THE SERVICE LIFE OF GAS INJECTION DEVICES USED TO INTRODUCE A GAS INTO MOLTEN METAL

This application is a continuation of application Ser. No. 07/733,220 filed Jul. 22, 1991, now abandoned.

During the growth of pneumatic metallurgy, a lot of gas injection devices have been developed around the world. During this time, the main objective has been to develop gas injection devices with longer service life, with the minimum risk of clogging.

This requirement is a compromise between the rate of wearing and the possibility of clogging:

The minimum rate of wearing is achieved with the minimum transverse area provided for gas passageways. Thus the clogging possibility it increased. On the other hand, if small transverse area is used, in some injection elements, for gas passageways, a high gas pressure is required to obtain the desired gas flow rate according to the objectives of the pneumatic process. In this case, there is a minimum level of pressure that must be delivered in order to overcome the well known back attack phenomenon; if such pressure level is not achieved during element operation, a great erosion rate will occur.

The improvement of the behavior of injection elements can be accomplished by the use of better refractories and other components of the injection device itself and/or modifying the gas injection parameters to reduce the mechanical erosion around the injection device and to promote the formation of a porous mushroom at the tip of the injection device during gas injection into molten metals. This mushroom formation is a practical and very effective way to increase the service life of injection elements and to avoid their clogging when the gas flow is cut off. Nevertheless, the genesis of such mushroom and its maintenance practice are difficult to achieve. Some companies are testing non-contact injection devices which are installed under the refractory ramming mix of the electric arc furnace bottom. The drawback of this practice is poor kinetic energy concentration, difficult gas control during the different process stages and the impossibility to direct the gas flow to specific areas.

It is therefore an object of the present invention, to provide for a method to improve the service life of gas injection devices by forming a mushroom on the tip of said injection devices before to the injection device installation in the metallurgical reactor.

Another object of the present invention is to provide an injection device with a porous mushroom formed with high stability at the tip of such injection device before its utilization to introduce gas into molten metals.

SUMMARY OF THE INVENTION

The present invention is characterized by an embodiment which forms by gas injection a porous mushroom artificially at the tip of the injection device. This embodiment is installed in a metallurgical reactor containing a liquid metal and a process or stirring gas is delivered to the liquid metal through said embodiment. During operation, the mushroom, at the tip of the injection device is in contact with the molten metal, and allows the gas flow through the porosity of the mushroom. The porosity is small enough to avoid metal infiltration when the gas flow is cut-off.

According to this invention, the porous mushroom is formed at the tip of the gas injection device by spraying molten materials while gas is blowing through the gas injection.

The mushroom formation is formed before installing the injection device in the metallurgical reactor.

DESCRIPTION OF THE PREFERRED EMBODIMENTS

Figure 1:
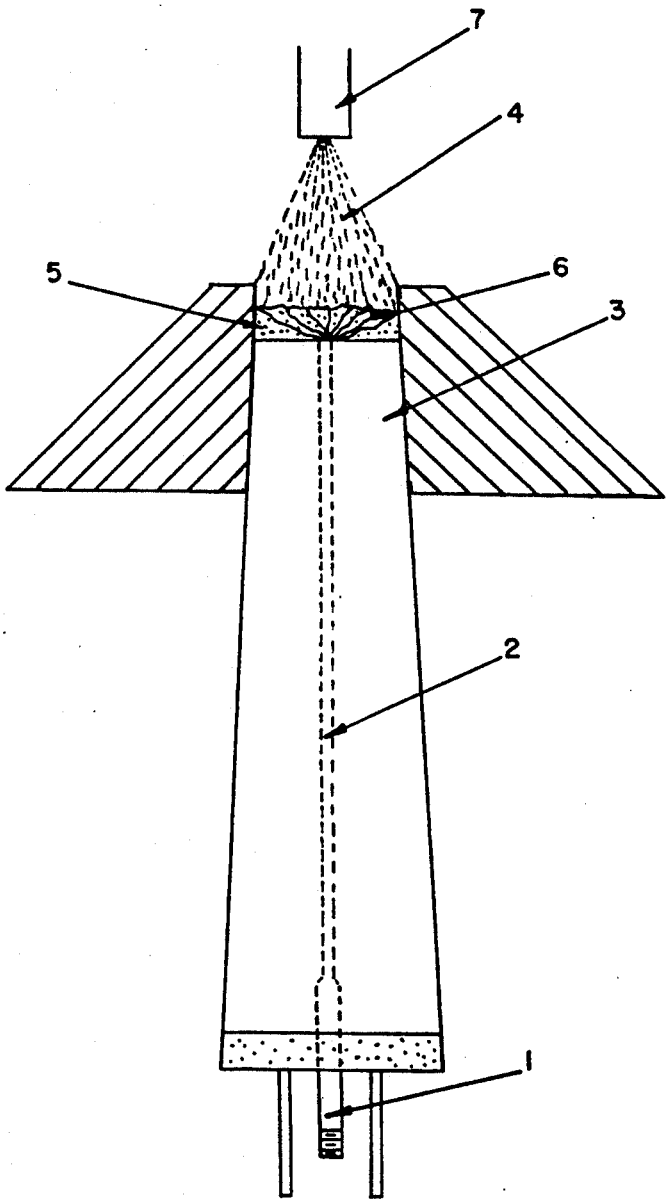
FIG. 1 is a diagrammatic side view of a system for producing a mushroom at the tip of the gas injection device.

The following is a description of the preferred method to form a mushroom in an injection device:

Referring to FIG. 1, a gas is introduced through the admission pipe 1, previously regulated to the gas flow rate and pressures desired with a gas control system not shown in FIG. 1. While the gas is flowing through tuyere 2 of the gas injection device, liquid or semi-liquid drops 4 of high melting point materials are sprayed on the tip of tuyere 2 and supporting brick 3. This semi-molten material 4 is accumulated and bonded progressively allowing the formation of a mushroom 5 having a gas flow directed channel os channels 6 into this deposited material depending on the inlet gas flow rate and pressure.

The permeability control of the process mushroom can be performed by the gas flow rate and pressure control.

The semi-liquid material 4 to be deposited is produced from powdered material which is pneumatically transported up to the spray nozzle 7. The powdered material at the spray nozzle can be heated by any kind of thermal spray process for example arc spray, plasma spray (under vacuum or controlled atmosphere) and flame spray. The best choice will depend on the materials to be sprayed.

The preferred materials have a high melting point as: refractory oxides, refractory metals, metal compounds or composites. Synthetic slags can also form mushroom according to the metal to be treated in the reactors.

In some cases a heat treatment is required to improve the mushroom mechanical strength properties and the bonding of the artificially formed mushroom with the supporting brick. The heat treatment can be accomplished under inert, vacuum or oxidizing atmosphere, according to the mushroom and base refractory composition.

Figure 2:
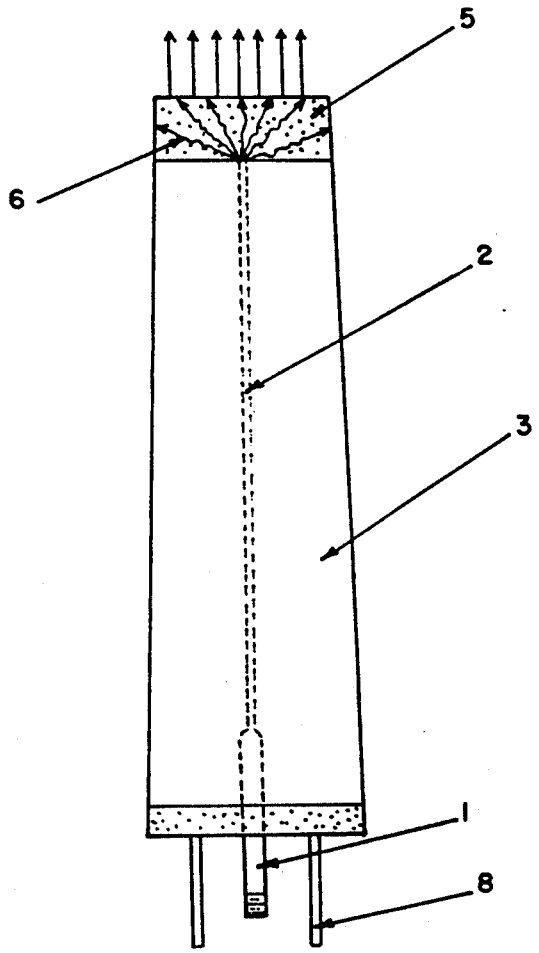
FIG. 2 is an injection device with its mushroom formed as described in the present invention.

The following is a description of an injection device having a mushroom:

Referring to FIG. 2, which is a device for injecting gas into a molten metal to be installed in the wall of a metallurgical reactor according to the present invention, said device comprises a tip section 5 formed, according to this invention of refractory material or a ceramic matrix composite which is highly resistant to molten metal corrosion and highly resistant to thermal shock. At least one extended channel 6 introduces the gas into the molten metal. such channels are small enough to avoid metal infiltration when the gas flow is cut-off. The brick section 3, is made of a low thermal conductivity and high mechanical strength material. This brick section 3 holds and protects the gas injection tuyere 2, by channeling the gas flow from admission pipe 1 to the tip section. Means 8 for element extraction are attached to the bottom of the brick section 3.

EXAMPLE

The following is an example of an injection device to be used in steelmaking at electric arc furnaces.

The injection device for this type of operation is prepared as follows:

The brick base section is made from a isostatic pressing and sintering powder selected from the group consisting of alumina, magnesite, alumina-magnesite and magnesite-chromite. After tuyere assembling a mushroom is formed on the tip of the brick section by plasma spray. The sprayed material is selected from the group consisting of magnesite, zirconia, prefused and ground synthetic slag with a basicity index higher than 3 and mixtures of the above materials. The injection device so manufactured is to be installed in the wall of a metallurgical reactor and comprises four main sections. A tip section is formed with refractory material of a ceramic matrix composite which is highly resistant to molten metal corrosion and to thermal shock. It has at least one channel, or controlled porosity, for introducing gas into the molten metal. The channel has small enough porosity to avoid metal infiltration when the gas flow is cut-off. The tuyere is a metallic conduit channeling the gas from the admission inlet to the tip section. The base section is made from materials of low electrical and thermal conductivity having high mechanical strength and holds and protects the gas injection tuyere. Means to extract the injection device are attached to the terminal end of the base section.

Although the present invention has been described in detail with respect to certain embodiments, those skilled in the art will recognize that there are other embodiments of this invention within the spirit and scope of the claims.

What is claimed and desired to be protected by letters patent is set forth in the appended claims:

1. A method for producing a long life, wear resistant gas injection device to be used for blowing gases into metals contained in metallurgical reactors, comprising the steps of isostatic pressing powders to form a base section of the device about a tuyere for insertion into a furnace for injecting gas, forming previously to element installation in the furnace of a tip of controlled shape on the base section for insertion into the furnace by thermal spraying and bonding progressively molten or semi-molten material while a gas is flowing through said tuyere allowing the formation of at least one channel for gas flow through the tip, and controlling permeability of the tip that is being formed by means of gas pressure and flow rate through the tuyere during the tip formation step to form said channels with porosity small enough to avoid molten metal infiltration into the tip when gas flow is cut-off in use of the injection device in a furnace.

2. A method as claimed in claim 1 further comprising the step of forming the base section from powdered materials in the group consisting of: chromite, magnesite, carbon, alumina, and ceramic matrix composites.

3. A method as claimed in claim 1 further comprising the step of forming the tip from he group of materials consisting of: zirconia; partially stabilized zirconia; alumina; magnesite; synthetic slags having a high melting point and a basicity index higher than 3 and mixtures of these materials.

* * * * *